US010492571B2

(12) United States Patent
Barr

(10) Patent No.: US 10,492,571 B2
(45) Date of Patent: Dec. 3, 2019

(54) INDENTED KEY RING

(71) Applicant: Caffeinate Labs, Inc, Portland, ME (US)

(72) Inventor: Nathan Gregg Barr, Portland, ME (US)

( * ) Notice: Subject to any disclaimer, the term of this patent is extended or adjusted under 35 U.S.C. 154(b) by 0 days.

(21) Appl. No.: 16/034,082

(22) Filed: Jul. 12, 2018

(65) Prior Publication Data

US 2018/0317613 A1 Nov. 8, 2018

Related U.S. Application Data

(63) Continuation-in-part of application No. 15/821,609, filed on Nov. 22, 2017, now abandoned, which is a continuation-in-part of application No. 15/152,561, filed on May 12, 2016, now Pat. No. 9,854,879.

(60) Provisional application No. 62/548,388, filed on Aug. 21, 2017.

(51) Int. Cl.
*A44B 15/00* (2006.01)
*E05B 19/00* (2006.01)

(52) U.S. Cl.
CPC ..... *A44B 15/002* (2013.01); *A44B 15/00* (2013.01); *E05B 19/00* (2013.01)

(58) Field of Classification Search
CPC ..... E05B 19/00; E05B 19/04; A44B 15/00; A44B 15/002
See application file for complete search history.

(56) References Cited

U.S. PATENT DOCUMENTS

| | | | | | |
|---|---|---|---|---|---|
| 603,247 | A | | 5/1898 | Becker | |
| 803,839 | A | | 11/1905 | Merrill | |
| 812,458 | A | | 2/1906 | See | |
| 1,286,501 | A | | 12/1918 | Bauer | |
| 1,391,364 | A | | 9/1921 | Bulow | |
| 1,462,205 | A | | 7/1923 | Fours | |
| 1,526,498 | A | | 2/1925 | James | |
| 1,558,364 | A | | 10/1925 | Iverson | |
| 2,361,069 | A | * | 10/1944 | Steinhardt | A44B 15/00 24/136 K |
| 2,410,951 | A | * | 11/1946 | Kuhnl | A44B 15/00 70/458 |
| 2,432,870 | A | | 12/1947 | Evalt | |
| 2,551,564 | A | * | 5/1951 | Marien | A44B 15/00 24/598.2 |
| 2,604,775 | A | | 7/1952 | Le Blanc | |
| 2,771,768 | A | | 11/1956 | Tudor | |
| 2,877,640 | A | | 3/1959 | Anderson | |
| 2,915,891 | A | | 12/1959 | Vealey | |
| 3,481,169 | A | * | 12/1969 | Rossi | A45C 11/32 70/408 |
| 3,513,675 | A | | 5/1970 | Ryder, Jr. | |
| 3,757,392 | A | | 11/1973 | Shteinshleifer | |

(Continued)

*Primary Examiner* — Christopher J Boswell
(74) *Attorney, Agent, or Firm* — Verill Dana, LLP; Robert L. Hover

(57) ABSTRACT

Provided herein is a low-profile key ring including a planar body including first and second inflection points, a connecting section extending between the first and second inflection points to define a concave indentation of the planar body, and a split disposed in the connecting section to define an outer segment and an inner segment of the connecting section, wherein the outer segment and inner segment are complementarily contoured.

15 Claims, 19 Drawing Sheets

(56) References Cited

U.S. PATENT DOCUMENTS

| | | | | |
|---|---|---|---|---|
| 4,077,243 | A * | 3/1978 | Tyson | A44B 15/00 70/459 |
| 4,129,021 | A | 12/1978 | Brentini | |
| 4,478,381 | A | 10/1984 | Pittion et al. | |
| 4,523,443 | A * | 6/1985 | Momemers | A44B 15/00 70/459 |
| 4,533,149 | A | 8/1985 | Vater et al. | |
| 4,844,487 | A | 7/1989 | Eakin | |
| 4,958,791 | A | 9/1990 | Nakamura | |
| 5,513,857 | A | 5/1996 | Watanabe et al. | |
| 5,619,875 | A | 4/1997 | Lahaussois | |
| 5,806,356 | A | 9/1998 | Lee | |
| 5,996,191 | A | 12/1999 | Christler | |
| 6,164,605 | A | 12/2000 | Drake et al. | |
| 6,488,461 | B1 | 12/2002 | Zacharias et al. | |
| 6,681,608 | B1 | 1/2004 | Hope | |
| 6,845,644 | B1 | 1/2005 | Buckner | |
| 6,860,130 | B2 | 3/2005 | Brantschem | |
| 7,011,482 | B2 | 3/2006 | Underwood et al. | |
| 7,093,468 | B2 | 8/2006 | Song | |
| 7,165,772 | B1 | 1/2007 | Camacho | |
| 8,104,315 | B2 * | 1/2012 | Perthou | A44B 15/00 206/38.1 |
| D666,407 | S | 9/2012 | Schoultz | |
| 9,854,879 | B2 | 1/2018 | Barr | |
| 2004/0068846 | A1 | 4/2004 | Karlinger | |
| 2004/0079126 | A1 | 4/2004 | Ullman | |
| 2006/0225257 | A1 | 10/2006 | Michelon | |
| 2010/0038506 | A1 | 2/2010 | King et al. | |

* cited by examiner

SECTION A-A

INDENTED KEY RING

CROSS-REFERENCE TO RELATED APPLICATIONS

This application is a continuation-in-part of U.S. patent application Ser. No. 15/821,609 filed on Nov. 22, 2017, which is a continuation-in-part of U.S. patent application Ser. No. 15/152,561 filed on May 12, 2016, and claims the benefit of priority to U.S. Provisional Patent Application No. 62/548,388, filed Aug. 21, 2017 and entitled "Key Ring with Corners and Attached Sliding Cover," the entire contents of these applications being incorporated herein by reference in their entirety.

TECHNICAL FIELD

The present invention relates generally to a low-profile ring for carrying keys or other accessories and attachments having a secure closure that is readily, but not unintentionally opened during use.

BACKGROUND

For centuries individuals have used key rings to hold, organize, and easily transport the keys they use on a regular basis. Some examples of prior art key rings are disclosed in the following United States Patents: U.S. Pat. No. 603,247 entitled "Key-Holder" ("'247 patent"), U.S. Pat. No. 1,462,205 entitled "Key Ring and the Like," and Pat. No. D666,407 entitled "Key Ring." These style key rings have the advantages of being durable and compact. However, it is often difficult to add or remove keys from these types of key rings, as the rings themselves can be very difficult to separate.

Split rings as commonly constructed have their free ends flush with the body of the ring, and when made of stiff or heavy metal it is extremely difficult to expand them sufficiently for the insertion or removal of a key with just fingers. Because of the difficulty, other aids, such as a knife-blade or other suitable article are often used to expand the split rings. Although the '247 patent issued in 1898, still, over a century later, modern day key rings are very difficult to separate in such a way so as to be able to add or remove a key.

FIG. 1 is a perspective view of a typical prior art key ring 100. As can be seen in FIG. 1, prior art key rings 100 usually consist of two concentric approximate circular supports 110, 120 that overlap one another. The lower support 110 and the upper support 120 are made as a single piece 102, often from metal which has been bent to form the two concentric approximate circular supports 110 and 120. One of the reasons that the two supports 110 and 120 are referred to as "approximate circles" and not just "circles" is because, as can be seen in FIG. 1, neither support 110, 120 is a comprised of a full 360-degrees of metal, or alternative material, on its own within a single plane. This design feature allows a user to longitudinally displace an end, e.g., 112 of either support 110 or 120 in order to add or remove a key.

Keeping keys securely in place is an obvious goal of any key ring. To keep keys in place, key rings must be able to withstand radial and orthogonal, out of plane forces that will be placed upon the key ring during ordinary use. Referring again to FIG. 1, radial forces would occur both as latitudinal forces along the x-axis 160 and longitudinal forces along the y-axis 165. In terms of orthogonal force, it is desirable for the key ring to require sufficient orthogonal force such that keys do not easily fall off of the key ring unintentionally. The orthogonal force should not, on the other hand, be so great that it is difficult to add or remove keys. The orthogonal force required to displace an end 112 of either support 110 or 120 sufficiently to facilitate the addition or removal of a key depends upon the ratio of the area moment of inertia (of the key ring cross section) to the diameter of the key ring. The area moment of inertia is proportional to the thickness of the key ring and the band width, defined as the difference between the outer and inner radii. Most key rings are designed with a sufficiently large wire gauge diameter to resist radial forces exerted on the key ring. However, the round nature of the prior art key ring as illustrated in FIG. 1 creates an equally resilient geometry resisting orthogonal forces. This results in a burdensome task for the user to overcome the orthogonal force required to add or remove keys, as described herein above.

Some inventors have addressed this long-standing problem by altering the basic shape of the key ring. By way of example, U.S. Pat. No. 803,839 entitled "Key-Ring," disclosed carabiner-style triangular and square key rings, while U.S. Patent Application No. 2008/0087063, entitled "Key Ring Assembly," is directed toward a key ring having a light bulb shape. While these types of key rings are easier to open than the traditional key rings described above, they are bulkier to carry, and therefore less desirable to a substantial number of consumers.

SUMMARY

There exists a need for a key ring that is capable of securely holding one's keys, while also providing an easy manner for adding and removing keys, without the need to rely on a separate tool or to risk harming one's fingers or nails.

Described herein is a flat, washer-like key ring that in one embodiment is cut in two dimensions from a sheet of metal to form a specific geometry. The geometry of the ring and metal combine to form a key ring that is strong in the direction of radial forces, but readily allows the ends of the ring to separate in the longitudinal direction upon application of a slight, but purposeful force by the user. The ends of the key ring are designed to easily allow a user's fingers to manipulate them into an open position, while remaining closed if not purposefully opened so that the keys do not accidentally fall from the ring. In addition, in one embodiment a key ring with a planar shape having corners and a sliding cover that can nominally slide around the key ring, but which stretches to slide over the key ring corners is provided. The slide cover may be secured to or removable with respect to other keychain components such as a key fob, strap, tag, tool, or case.

In addition, in another embodiment, a key ring with a planar shape having a concave indentation and a cover with a mechanical clasp that can be unclasped to reveal the split in the key ring is provided. With the cover in place and the mechanical clasp engaged, the key ring cannot fully rotate to reveal the split within the connecting section. Disengaging the mechanical clasp allows the user to rotate the key ring to access the split to add or remove keys or other looped objects. The cover may be integral or removable with respect to other keychain components such as a key fob, strap, tag, tool, or case.

In one embodiment, a low-profile key ring is provided. The low-profile key ring includes a planar body including first and second inflection points. The low-profile key ring also includes a connecting section extending between the first and second inflection points to define a concave indentation of the planar body. The low-profile key ring also includes a split disposed in the connecting section to define an outer segment and an inner segment of the connecting section, wherein the outer segment and inner segment are complementarily contoured.

In some embodiments, the complimentary contouring of the outer segment and the inner segment is suited for securing the outer segment to the inner segment and releasably detaching the outer segment from the inner segment. In some embodiments, the outer segment or the inner segment further comprises at least one protrusion and at least one slot. In some embodiments, the low-profile key ring also includes a slide cover configured to slide over at least one of the first inflection point or the second inflection point to cover the connecting section. In some embodiments, the slide cover also includes a loop extending through the planar body. In some embodiments, the slide cover also includes a mechanical clasp positioned proximate the loop for defining a closeable passage. In some embodiments, the closeable passage, in an open configuration of the mechanical clasp, is sized to permit rotation of the planar body therethrough. In some embodiments, the closeable passage, in a closed configuration of the mechanical clasp, is sized to restrict rotation of the planar body therethrough. In some embodiments, the concave indentation is sized to accommodate the mechanical clasp. In some embodiments, when the mechanical clasp is in a closed configuration and accommodated within the concave indentation, the slide cover covers the connection section and the outer segment and the inner segment are restricted from releasably detaching at the split. In some embodiments, the slide cover also includes a fastener for securing the loop around the planar body.

In another embodiment, a method of making a low-profile key ring is provided. The method includes cutting or stamping a planar body wherein the body is shaped as substantially circular, oval, elliptical, square, rectangular, trapezoidal, S-shaped, or polygonal. The method also includes forming first and second inflection points. The method also includes forming a connecting section extending between the first and second inflection points to define a concave indentation of the planar body. The method also includes creating a split in the connection section wherein the split forms an outer segment and an inner segment within the connection section, the outer and inner segments further comprising complimentary contouring. The method also includes securing a loop of a slide cover to the body, the slide cover configured to slide over at least one of the first inflection point or the second inflection point to cover the connecting section upon application of manual force.

In some embodiments, the method also includes installing a mechanical clasp in the slide cover, the mechanical clasp sized to be accommodated by the concave indentation of the body. In some embodiments, the method also includes rotationally aligning the mechanical clasp with the concave indentation. In some embodiments, the method also includes closing the mechanical clasp to restrict rotation of the body relative to the slide cover and to restrict the outer segment and the inner segment from releasably detaching at the split.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments, and are incorporated in and constitute a part of this specification, but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

DETAILED DESCRIPTION OF THE ILLUSTRATIVE EMBODIMENTS

The examples of the apparatus discussed herein are not limited in application to the details of construction and the arrangement of components set forth in the following description or illustrated in the accompanying drawings. It will be understood to one of skill in the art that the apparatus is capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus herein referred to in the singular may also embrace embodiments including a plurality, and any references in plural to any embodiment, component, element or act herein may also embrace embodiments including only a singularity (or unitary structure). References in the singular or plural form are not intended to limit the presently disclosed apparatus, its components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Those of skill in the art will recognize throughout this specification that when like terms are used to describe features and functionalities of various portions of a particular embodiment, those same features and functionalities could be present in additional embodiments having aspects with like terms.

Figure 1:
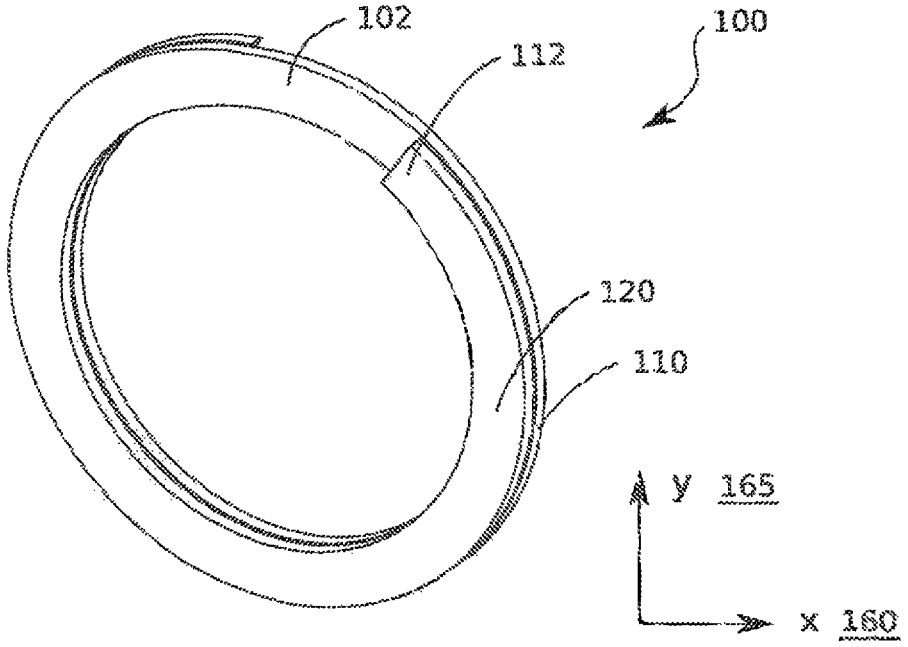
FIG. 1 (PRIOR ART)
FIG. 1 is a perspective view of a prior art key ring.
Figure 2A:
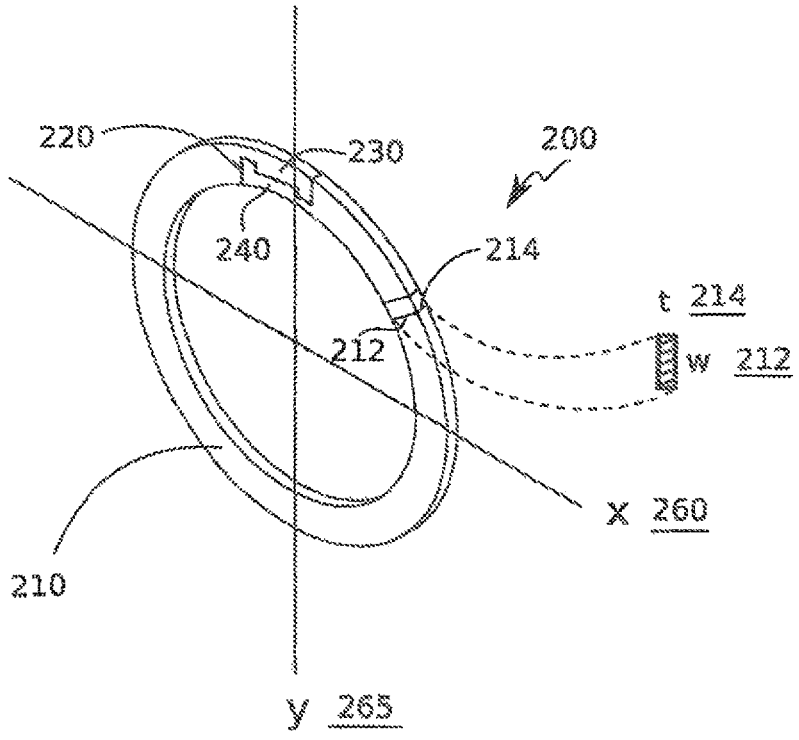
FIG. 2A is a perspective view of a low-profile key ring of a first exemplary embodiment.

FIG. 2A illustrates a first embodiment of a key ring 200 according to the present disclosure. The key ring 200 of this embodiment is comprised of low-profile body 210 having a split 220 forming an outer segment 230 and an inner segment 240, the outer and inner segments 230, 240 engaging each other through corresponding outer and inner protrusions 232, 242 and outer and inner receiving slots 234, 244. As will be appreciated, one measure of the flatness, i.e. profile, of an object is its aspect ratio of a cross-sectional area taken as a function of width over thickness. In the present embodiment of the key ring 200, the aspect ratio of a cross sectional area, taken as a function of width 212 over thickness 214 may range from approximately 2 to 6. The planar key ring 200 may occupy a single plane, as opposed to having stacked geometric shapes, as disclosed in the prior art, for example FIG. 1.

Figure 3A:
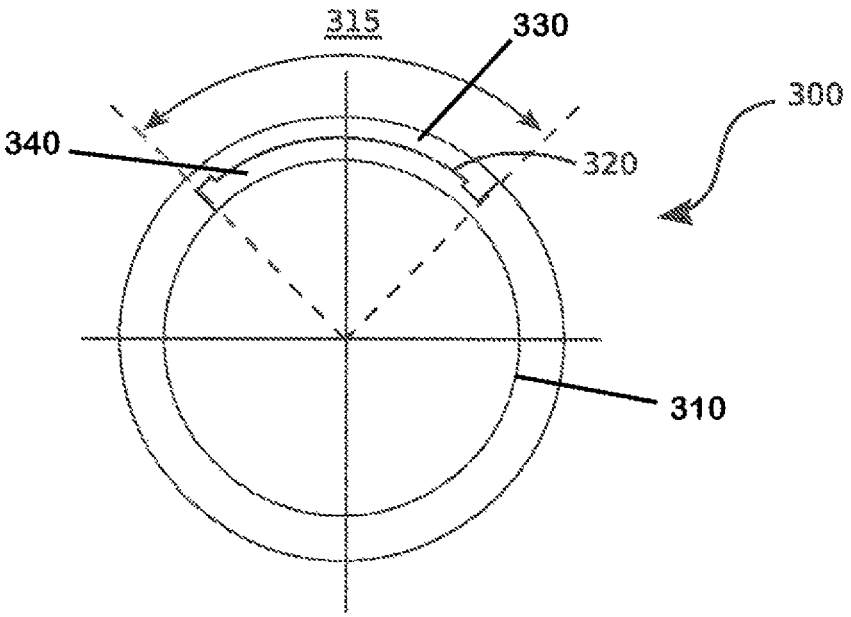
FIG. 3A is a plan view of the low-profile key ring of FIG. 2A.
Figure 3B:
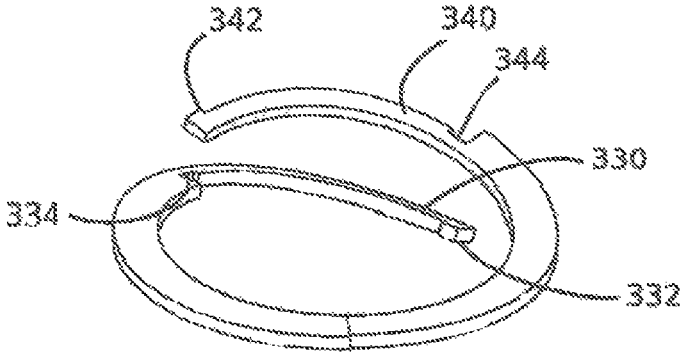
FIG. 3B is a perspective view of the low-profile key ring of FIG. 2A illustrating opening of the key ring.

As can be seen in FIG. 2A, key ring 200 includes a split 220 within the planar structure of body 210 having a desired shape. An alternate embodiment of key ring 300 is shown in FIG. 3A, including a split 320 that is a cut through the body 310 of the low-profile key ring 300 having a different desired shape than the split 220 of FIG. 2A. The split 220, 320 can be formed with a laser cutter, an electrical discharge machining (EDM), electro-chemical erosion, water jet cutting, or similar techniques known to those skilled in the art. When the split 230, 320 is cut into the body of the key ring 200, 300, the result is that a portion of the key ring 200, 300 is cut into the outer segment 230, 330 and inner segment 240, 340, as can be seen in FIGS. 2A and 3B. The outer segment 230, 330 and the inner segment 240, 340 are complimentarily contoured so that they can engaged each other to form a secure hold in a closed, or engaged position. In some embodiments, the outer segment 230, 330 or the inner segment 240, 340, or both, may further include complimentary protrusions and/or slots.

Figure 2B:
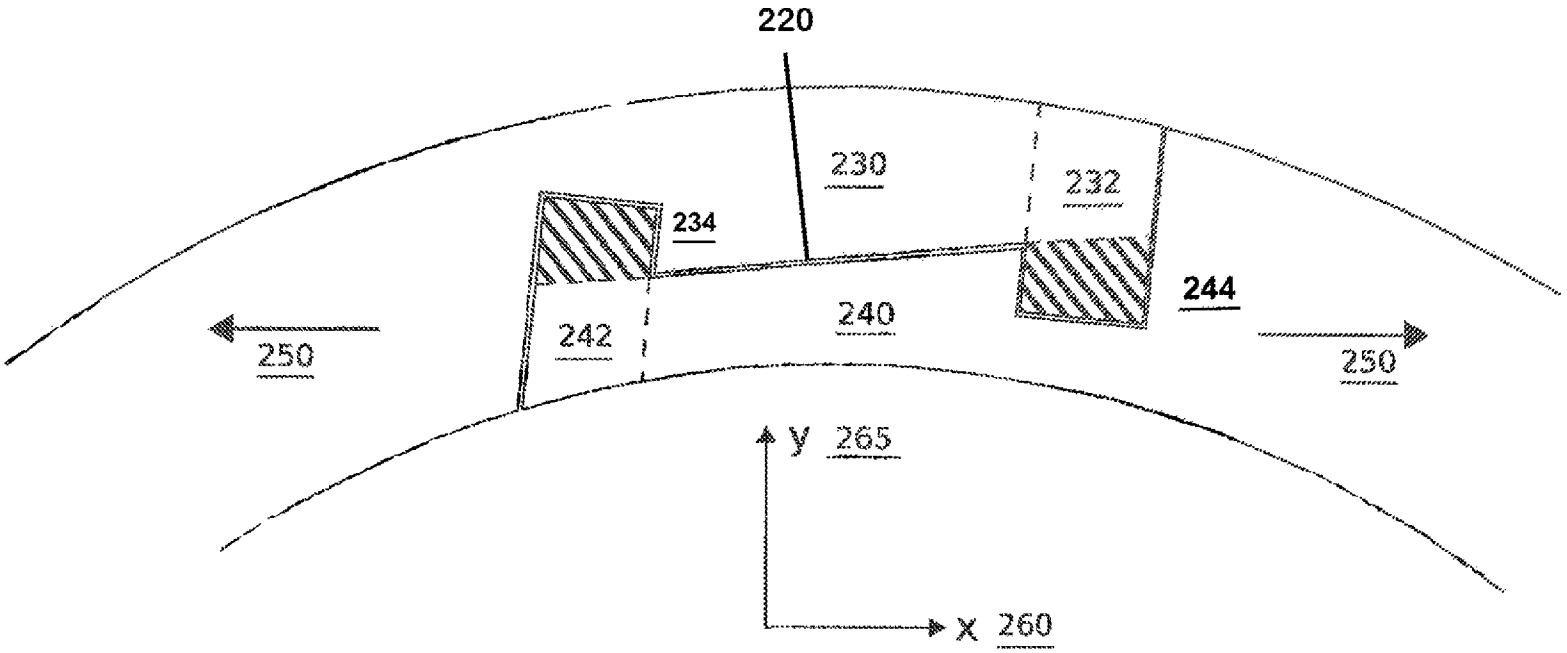
FIG. 2B is a plan view including a partial cross-section of the low-profile key ring of FIG. 2A.

Referring now to FIGS. 2B, 3B, the outer segment 230, 330 includes protrusion 232, 332 and slot 234, 334 that are constructed and arranged to engage each other in an interlocking relationship. Inner segment 240, 340 includes protrusion 242, 342 and slot 244, 344 that are likewise constructed and arranged to engage each other. The protrusions 232, 242 and 332, 342 are configured to fit securely within corresponding slots 244, 234 and 344, 334, thereby creating a complimentarily contoured surface that facilitates interlocking engagement between the outer segment 230, 330 and the inner segment 240, 340 when in a closed position. When the outer segment 230 is secured to the inner segment 240 the protrusions 232, 242 fit securely within receiving slots 234, 244 in their complimentary contoured counterpart, which is shown as diagonal lines within FIG. 2B.

Figure 3C:
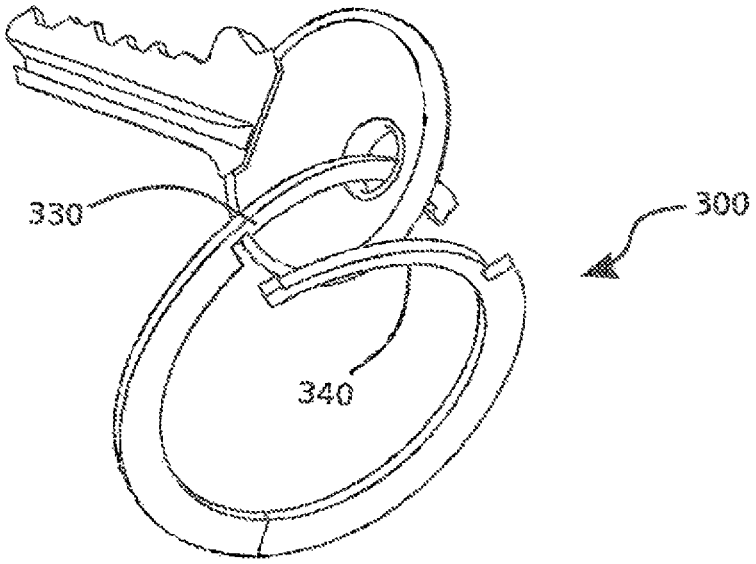
FIG. 3C is a perspective view of the low-profile key ring of FIG. 3B illustrating adding or removing of a key when the key ring is in the open position.
Figure 3D:
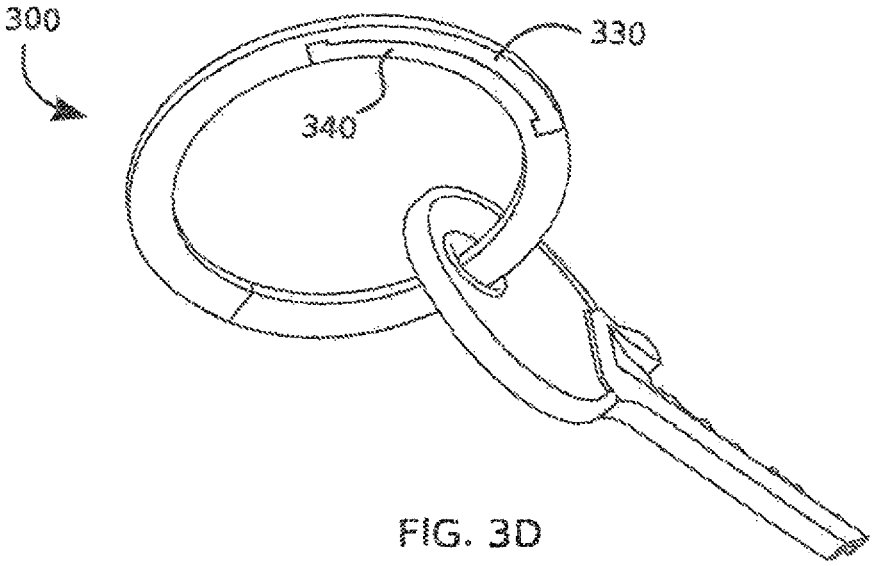
FIG. 3D is a perspective view of the low-profile key ring of FIG. 2A showing a key secured thereon.

FIG. 3C depicts the key ring 300 in a released, or open position, where the outer segment and inner segment 330 are separated from one another such that a space is formed therebetween. When the key ring 300 is in the released position, it is well suited for adding or removing a key to the key ring 300, as shown. A key can be added or removed by separating the outer segment 330 from the inner segment 340 a sufficient distance to allow a key to pass therebetween. FIG. 3D depicts the outer segment 330 and the inner segment 340 being once again engaged after a key has been added to the key ring 300.

With reference again to FIG. 2A, the key ring 200 is also designed so as to resist excessive strain due to the hoop stress of tensile radial forces exerted along both the latitudinal x-axis 260 and the longitudinal y-axis 265. As those of skill in the art will recognize, a sufficient radial force applied along the x-axis 260 will force the inner 240 and outer 230 segments of the key ring 200 to become detached from one another, which may result in the loss of keys. Similarly, a longitudinal force could have the same effect. In order to increase the radial strength of the key ring, embodiments herein have been designed so as to take advantage of the physics that follow from the geometry forming relative heights and angles of the protrusions 332, 342 and slots 334, 344 that have been described hereinabove.

If there is insufficient hoop-strength integrity in the design of the key ring 200, the outer segment 230 will separate from the inner segment 240 along the x-axis 260. This could result in a gap between the outer segment 230 and the inner segment 240 large enough to allow a key(s) to slip off of the key ring 200. It could also result in the hoop stress exceeding the elastic deformation limit, and thus permanently deform the key ring 200 potentially rendering it unusable. When latitudinal radial force 250 is applied to the key ring 200, an outer edge 243 of the protrusion 242 transfers approximately half of force 250 through the split side and half of force 250 through the proximal side. Thus, effectively reducing the hoop stress by 50% and of the body 210 to sustain a greater force 250 without deformation. This transfer will occur so long as the relative angle between the x-axis 260 and the outer edge 243, using the axes depicted, ranges from about 60-degrees to about 90-degrees. The lower range is dependent on the coefficient of friction for the material and surface roughness of key ring 200. The upper range of the relative angle could be beyond 90 degrees, in essence forming a "hook", but without any significant functional advantage.

Longitudinal forces are accounted for by virtue of the engagement of the protrusions 332, 342 and slots 334, 344. The complimentary contouring of the inner 340 and outer 330 segments of the key ring 300 diminish longitudinal forces, using a similar behavior as previously described for the latitudinal forces, thereby keeping keys securely in place.

Figure 4:
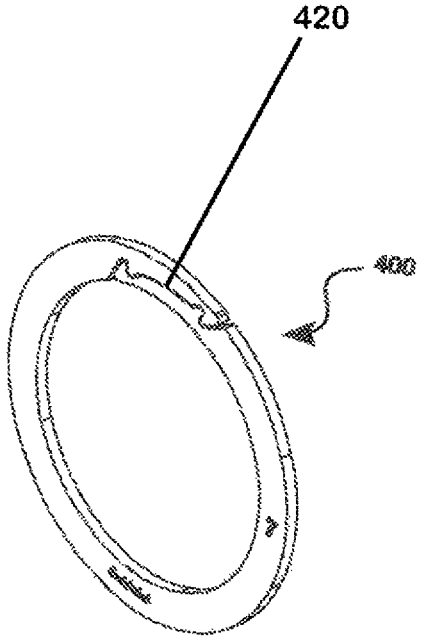
FIG. 4 is a perspective view of a low-profile key ring of a second exemplary embodiment.
Figure 5:
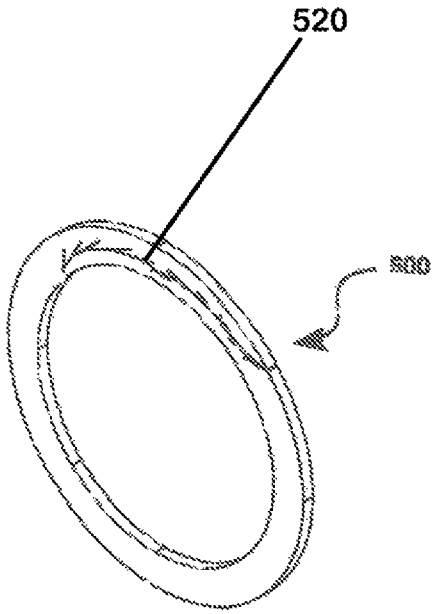
FIG. 5 is a perspective view of a low-profile key ring of a third exemplary embodiment.
Figure 6:
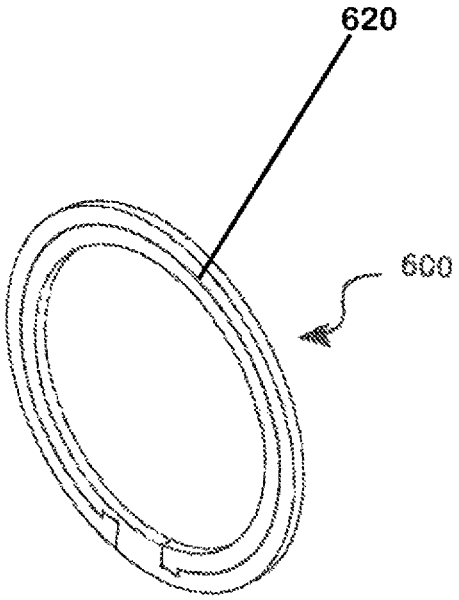
FIG. 6 is a perspective view of a low-profile key ring of a fourth exemplary embodiment.

The arc angle of the split can vary within a range of between 5-degrees and 355-degrees. FIG. 3A depicts an arc angle 315 that is approximately 90-degrees, while FIG. 6 depicts an arc angle approaching 355-degrees. The size of the arc angle 315 depends upon the arc length of the split 320 line cut through the body of the key ring 300. FIGS. 4-6 depict alternate embodiments having splits with varying arc angles and various arc lengths.

Those of skill in the art will recognize that the number of protrusions and slots is not limited to a pair of complementary contoured protrusions and slots as depicted in FIGS. 2A-3D. FIG. 5 depicts split 520 with many pairs of protrusions and slots which are complementary contoured. The shape of the complementary contoured protrusions and slots is not limited, and one of skill in the art will recognize that the protrusions and slots can take many complementary contoured configurations. By way of example only, FIGS. 2A-3D depicts splits 220 and 320 in which the complementary contoured protrusions and slots are squared, while FIG. 4 depicts split 420 in which the complementary contoured protrusions and slots have curved profiles and FIG. 5 depicts split 520 in which the complementary contoured protrusions and slots have a serrated contour. In each exemplary embodiment described, the protrusions are configured to matingly fit within the slots, to form a secure connection, thereby creating a complimentarily contoured surface that facilitates engagement between the outer segment and the inner segment.

In terms of substantial circularity, key rings 200, 300, 400, 500, 600 are depicted as circular. Those of skill in the art will recognize that the key rings 200, 300, 400, 500, 600 could be any of a variety of shapes, for example circular, oval, elliptical, square, rectangular, trapezoidal, or polygonal.

Figure 7A:
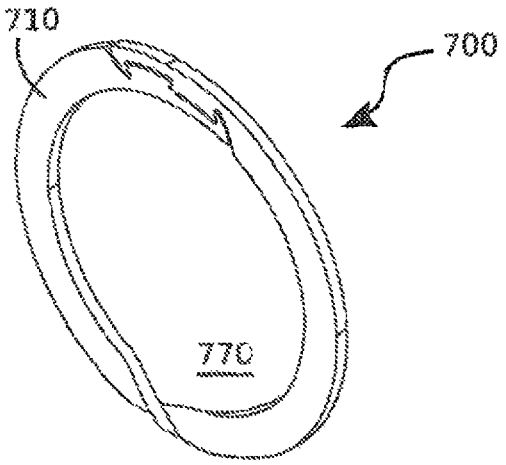
FIG. 7A is a perspective view of a low-profile key ring of a fifth exemplary embodiment including a twist.
Figure 7B:
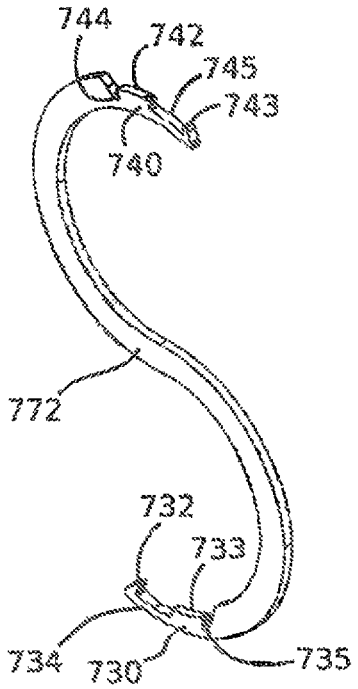
FIG. 7B is a perspective view of the low-profile key ring of FIG. 7A including an S-shaped body member.

FIG. 7A shows an alternative key ring 700 with a twisted portion 770 disposed in the body 710. FIG. 7B shows how this embodiment may be formed from an S-shaped member having an outer segment 730 with protrusions 732, 733 and slots 734, 735 and an inner segment 740 having protrusions 742, 743 and slots 744, 745. The S-shaped member could be formed into key ring 770 by heating and twisting the body 710 so that it changes its shape to be looped, and in some embodiments, substantially circular as depicted in FIG. 7A. In alternate embodiments, the shape could of key ring 700 could be oval, elliptical, square, rectangular, trapezoidal, or polygonal. In yet alternate embodiments, the key ring 700 could be formed by stamping; pressing the S-shaped member could create the twist 770 in the body of the key ring 700.

In certain embodiments, the low-profile key ring can range in outer diameter from approximately 0.25 inches to 2.5 inches. Additionally, band width, defined as the difference between the outer and inner radii, can range in from approximately 0.05 inches to 0.25 inches. The inner diameter is perhaps best expressed as a percentage of the outer diameter, and in such case could range from approximately 50% to 95%. Additionally, key ring embodiments could range in thickness from approximately 0.01 inches to 0.25 inches. The thickness is perhaps best expressed as a percentage of the key ring band width, determined as the difference in the outer and the inner radii, and in such case could range from 20% to 100%. The preferred embodiment has an outer diameter of between approximately 1.25 inches and 1.5 inches. Additionally, the preferred embodiment has an inner diameter of approximately 80% of the outer diameter and a thickness roughly 30% of the band width.

In certain embodiments, the flat, planar, looped key ring embodiments could be made of metal (for example and without limitation, stainless steel, ferromagnetic steel, other purpose steels, gold, silver, copper, titanium, aluminum, tungsten, or zinc), wood, plastic, silicone, plastic, ceramic, carbon fiber, or rubber. Some of these materials can be subjected to treatment, such as hardening to further strengthen the compact key ring body. For example, certain forms of both stainless and general purpose steel can be heat treated by heating the metal in a furnace to the critical temperature to change the molecular structure and then quenching to quickly cool the material and retain the modified molecular structure. In these embodiments, it is desirable to temper the metal at a lower temperature in a furnace shortly after quenching to restore a certain amount of toughness and reduce the brittleness of the material.

In alternate embodiments, the metal can be "cold" worked, such as cold rolling sheet metal, to impart internal stress into the bulk of the material, which acts similarly to heat treatment in modifying the physical properties of the material. Proper selection of material is important so that the key ring can be used for the intended functions without sustaining plastic deformation, as is the case when the applied stress exceeds the yield strength of the material. Hardening the metal, such as with the techniques described above, can help by increasing the yield strength of the material.

In one embodiment, the application of fine processes, such as laser cutting, allow for the present invention to achieve the desired balance between maximizing product strength and minimizing key ring split line thickness. In alternate embodiments, the cutting tool could be an electrical discharge machining (EDM), electro-chemical erosion, water jet cutting, or similar techniques known to those skilled in the art. In an alternate embodiment, the key ring could be created by using a blanking or even fine blanking stamping die to punch parts out of the sheet metal. In these embodiments, and others that are similar and known to those of skill in the art, the application of fine processes allows for precision edges, shapes, sizes, contours, and notches to be created thereby facilitating the operational and structural capabilities of the key ring features discussed herein.

Accordingly, in a method embodiment of the present invention, the method is comprised of forming a substantially flat, planar key ring comprising cutting or stamping a single planar member wherein the member looped and is shaped as substantially circular, oval, elliptical, square, rectangular, trapezoidal, S-shaped, or polygonal; and creating a split in the member wherein the split forms an outer segment and an inner segment within the planar body, the outer and inner segments further comprising complimentary contouring suited for engaging the outer segment to the inner segment and releasably detaching the outer segment from the inner segment.

Figure 8A:
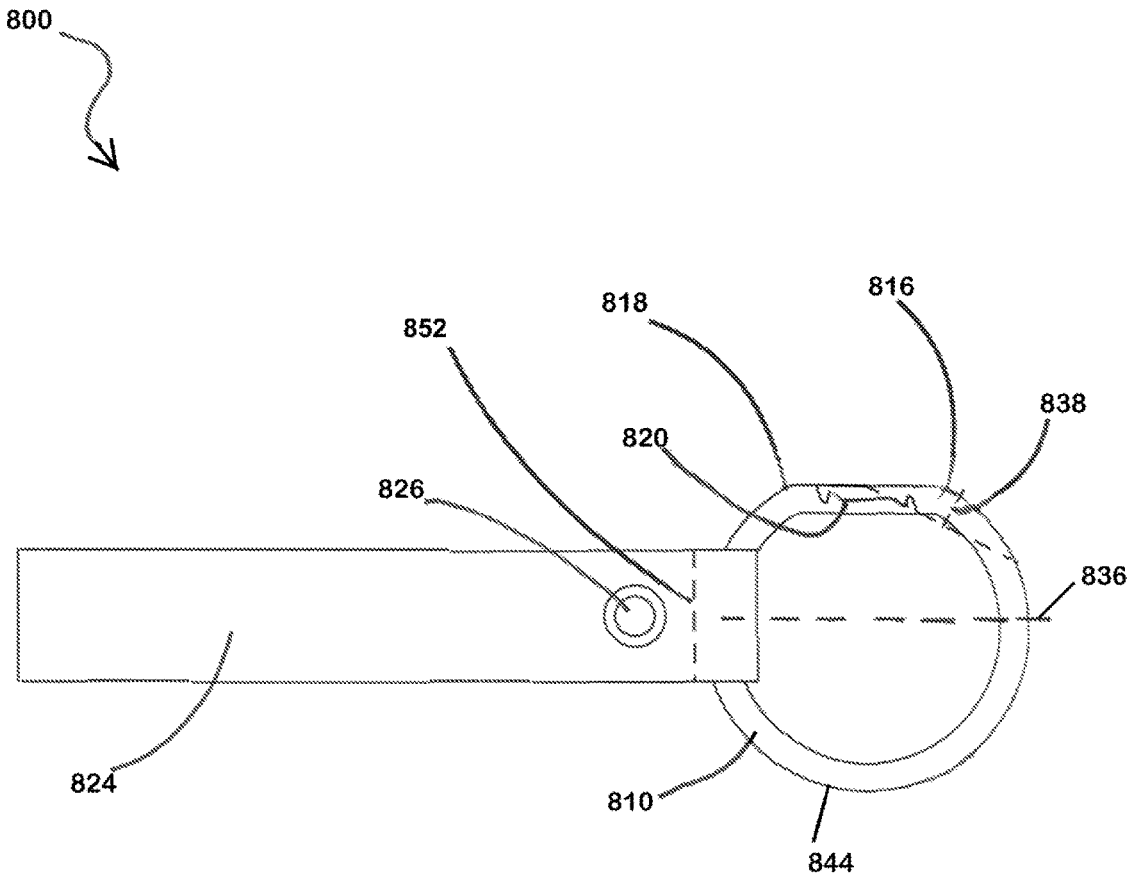
FIG. 8A is a top elevation view of a low-profile key ring and a slide cover according to a sixth exemplary embodiment in a first position.

Referring now to FIG. 8A, in another embodiment the low-profile body 810 of the key ring 800 is generally circular, and the circular shape includes two corners 816 and 818 with a connecting section 822 is positioned between corners 816 and 818. Split 820 is located within the connecting section 822. In alternate embodiments, the shape could of key ring 800 could be oval, elliptical, square, rectangular, trapezoidal, or polygonal.

In the present embodiment, the connecting section 822 is linear and parallel to diameter 836, but the connecting section 822 may be curved or angular, and is not limited to a structure that is linear or parallel to the diameter 836. The connecting section 822 may form a concavity and project toward the interior of the body 810, form a protrusion and extend outward, away from the interior of the body 810, or may comprise an irregular shape or contour.

The key ring 800 may optionally include a slide cover 824. The slide cover 824 is secured to the body 810 in any known method, for example by a fastener 826 which can include, but is not limited to, a grommet, a rivet, a stitching, or bonding. In the present embodiment, the slide cover is a strap 824, but one of skill in the art will recognize that slide cover 824 includes, but is not limited to, components such as a key fob, a strap, a tag, a tool, a case, or other component secured to body 810. The material of the slide cover 824 may include, but is not limited to, natural or synthetic fabrics, nylon straps, carbon fiber textiles, leather, synthetic leather, rubber, plastic sheet, plastic strapping, cord, twine, or other suitable materials used either alone or in combination in order to obtain the desired characteristics.

Figure 8B:
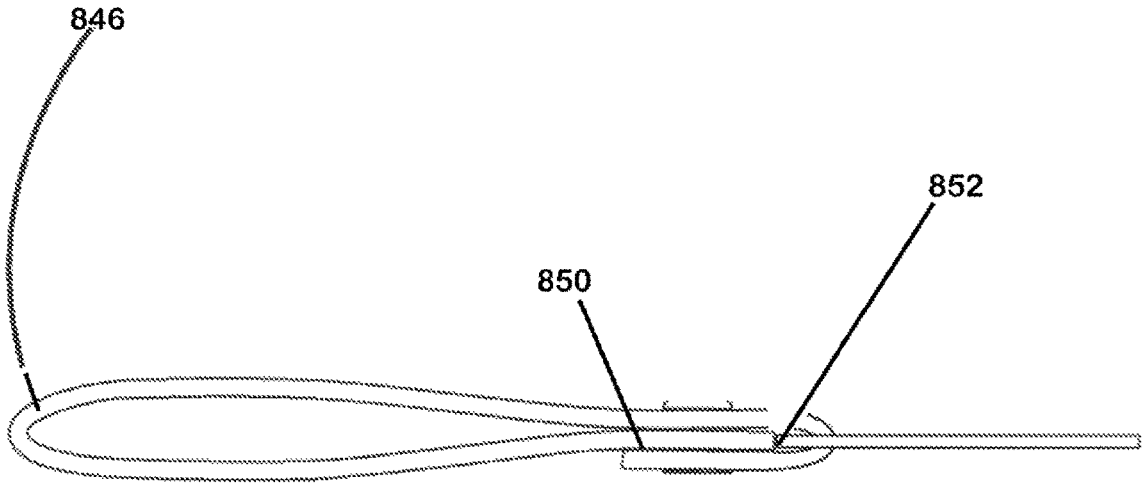
FIG. 8B is a side elevation view the key ring and slide cover of FIG. 8A.
Figure 8C:
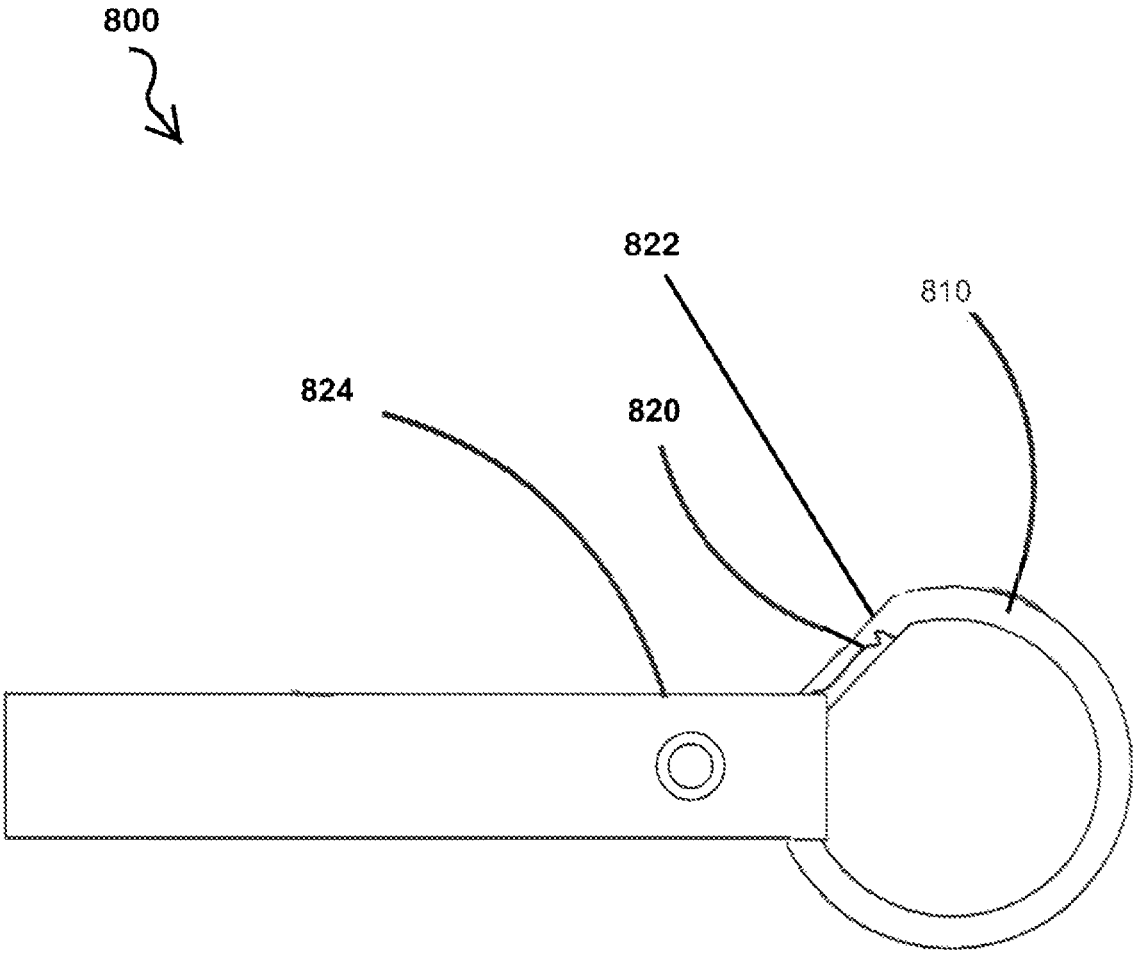
FIG. 8C is a top elevation view of the key ring and slide cover of FIG. 8A in a second position.
Figure 8D:
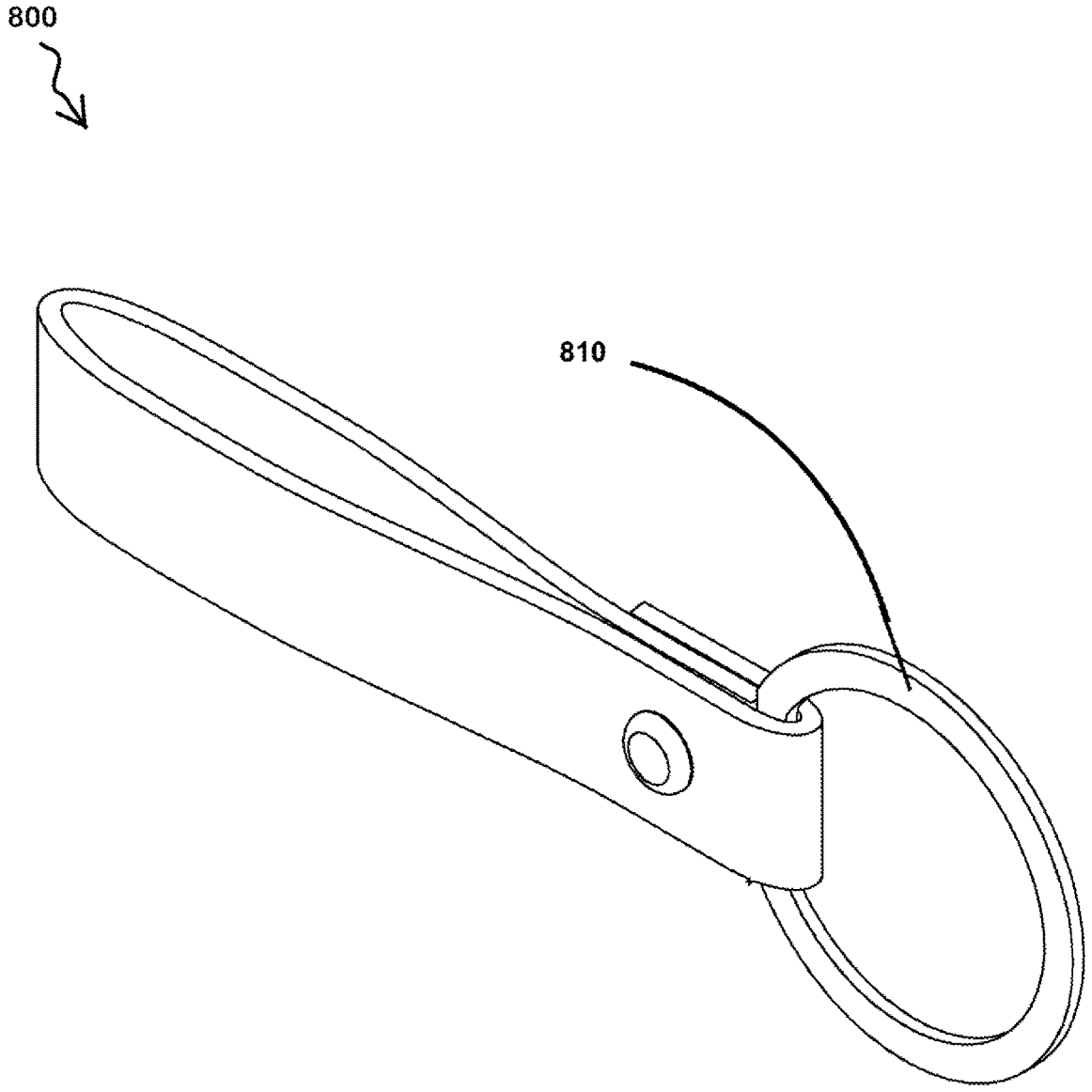
FIG. 8D is a perspective view of the key ring and slide cover of FIG. 8A in a third position.
Figure 8E:
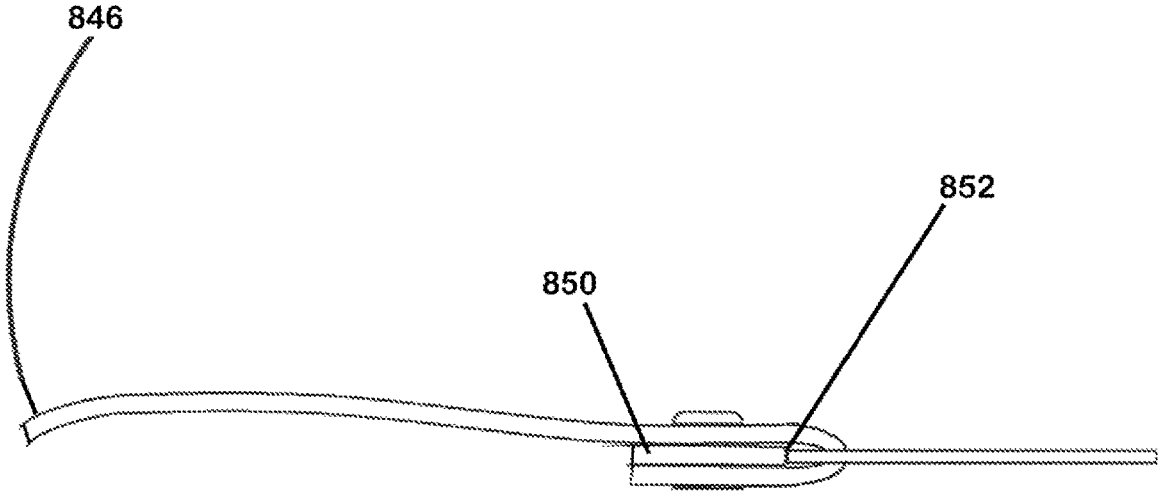
FIG. 8E is a side elevational view of an alternate embodiment of the key ring and slide cover of FIG. 8A.

As shown in FIGS. 8D-8E, the slide cover 824 may be rotated by the user in order to cover the connecting section 822, thus securing the split 820 and preventing accidental separation of the outer segment 330 and inner segment 340, thereby preventing in advertent loss of keys or other items that may be held on the body 810.

Referring now to FIGS. 8A-8E, the slide cover 824 may include a compression region 852. The compression region 852 is formed to accommodate dimension 838 adjacent to corner 816 or 818 when the slide cover 824 is rotated by the user to cover the split 820 and the connecting section 822. The compression region 852 may be formed by positioning the fastener 826 in order to create contact between the outer edge 844 of the body 810 and the slide cover 824. As shown in FIG. 8B, the slide cover 824 is a strap with a rolled end creating a loop 846, and the compression region 852 is created through direct contact between the constriction element 850 of the slide cover 824 coming into direct contact with the outer edge 844 of body 810. If slide cover 824 is a tag or handle, and therefore lacking loop 846, the compression region 852 may be created by positioning the fastener 826 in close proximity to the outer edge 844 such that a compression region 852 is created.

Referring to FIG. 8C, in another embodiment, the constriction element 850 may be a separate element that is not contiguous with slide cover 824. In this embodiment, the constriction element 850 is comprised of a low durometer material measuring between approximately 10 and 80 on the Shore 00 hardness scale. Such materials include, but are not limited to, rubber, reinforced rubber, natural rubber, silicon rubber, urethane, neoprene, flouroelastomer, flourosilicone, polyurethane, EPD foam, foam rubber, santoprene, buta-n-latex polyethylene, or vinyl. As shown in FIG. 8E, the slide cover 824 is a strap, and the compression region 852 is created through direct contact between the constriction element 850 coming into direct contact with the outer edge 844 of body 810.

In another embodiment, the corners 816 and 818 may create dimension 838 which is greater than the width formed by the compression region 852. In order to position the slide cover 824 over the connecting section 822 the material of the slide cover 824 may stretch when manipulated by the user and rotated past the corners 816 and 818. After the slide cover 824 is positioned to cover the connecting section 822 by the user, the slide cover 824 preferentially stays in this secure position. In certain embodiments, the force required to stretch the material to the necessary width can be high enough to prevent the slide cover 824 from accidentally sliding past the corners 816 and 818 and uncovering connecting section 822 without intentional application of manual force.

Referring to FIG. 8E, this configuration allows the user to carry the key ring 800 with the split 820 covered by the slide cover 824 as a means of providing additional security when the force exerted by keys and other objects placed on body 810 may be great enough to cause the inner 240 and outer 230 segments to separate and allow keys or other objects to slide off the key ring 800.

Figure 9A:
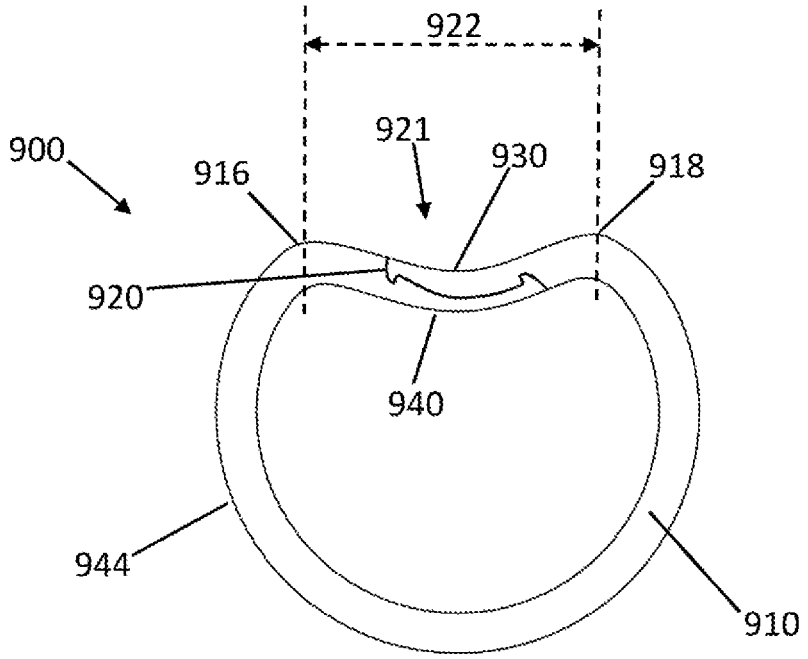
FIG. 9A is a top elevation view of an indented low-profile key ring according to a seventh exemplary embodiment.
Figure 9B:
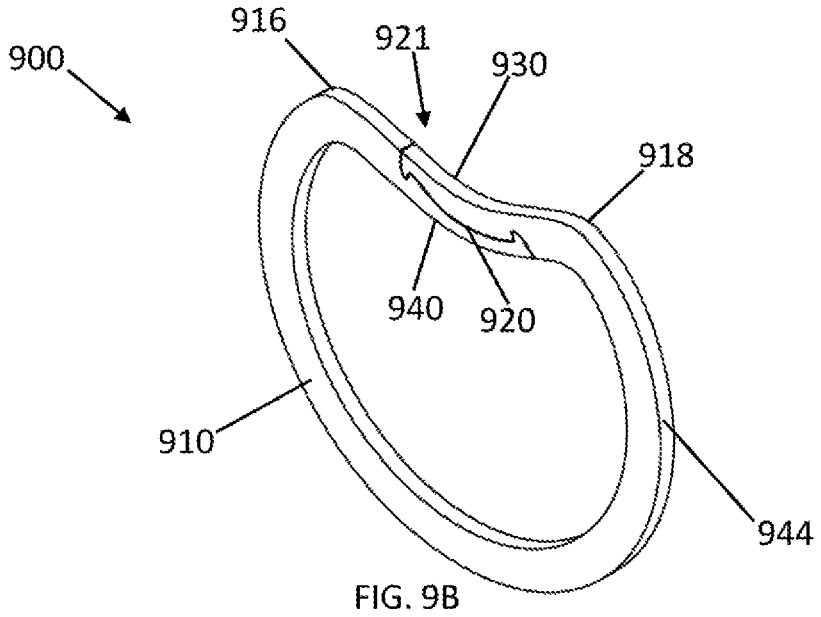
FIG. 9B is a perspective view the indented key ring of FIG. 9A.

Referring now to FIG. 9A, in another embodiment the low-profile body 910 of the key ring 900 is generally circular in shape, including along an outer edge 944 of the body 910. The body 910 includes a connecting section 922 extending between two inflection points 916 and 918. The connecting section 922 defines a concave indentation 921 therein between the two inflection points 916 and 918. It will be apparent in view of this disclosure that, although shown as being generally circular, the shape of the body 910 of key ring 900 can be any suitable shape including, for example, oval, elliptical, square, rectangular, trapezoidal, or polygonal.

Figure 9C:
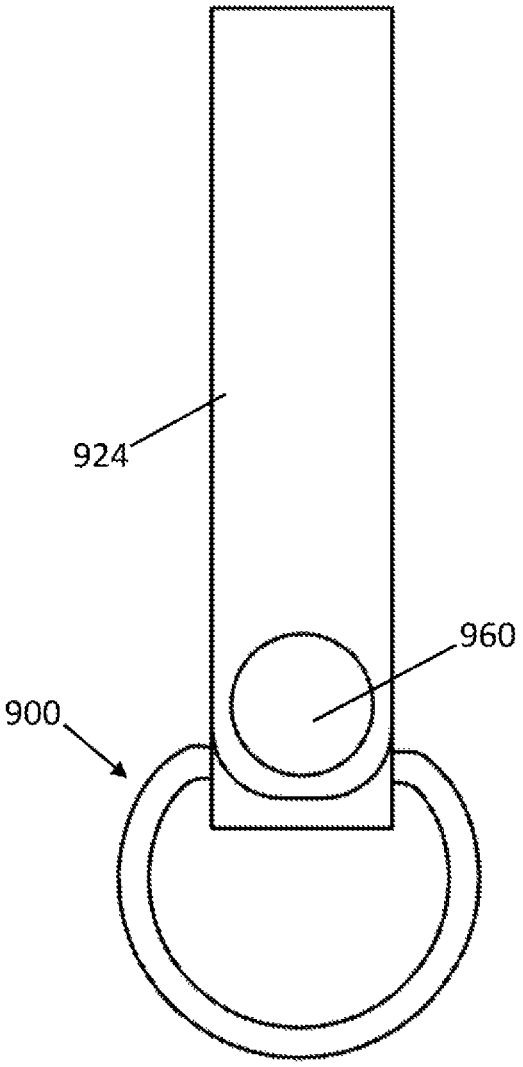
FIG. 9C is a top elevation view of the indented key ring of FIG. 9A installed in a slide cover.
Figure 9D:
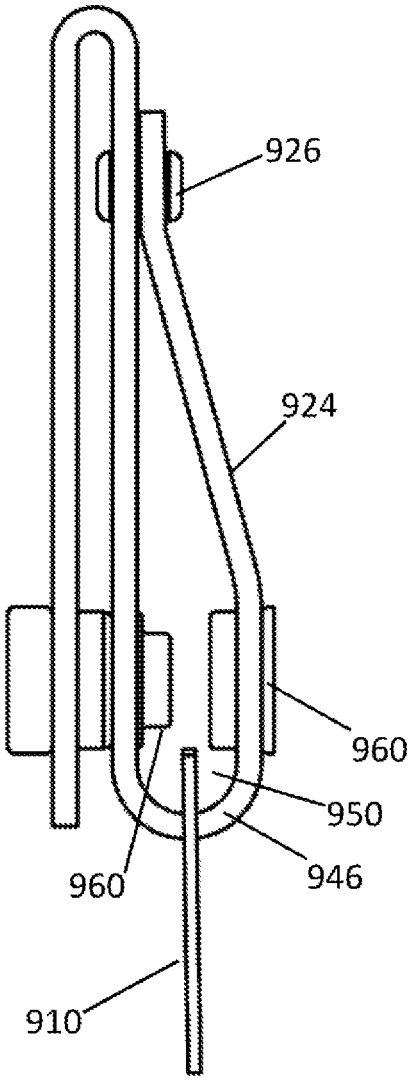
FIG. 9D is a side elevation view of the indented key ring installed in the slide cover of FIG. 9C in an open configuration of the slide cover.
Figure 9E:
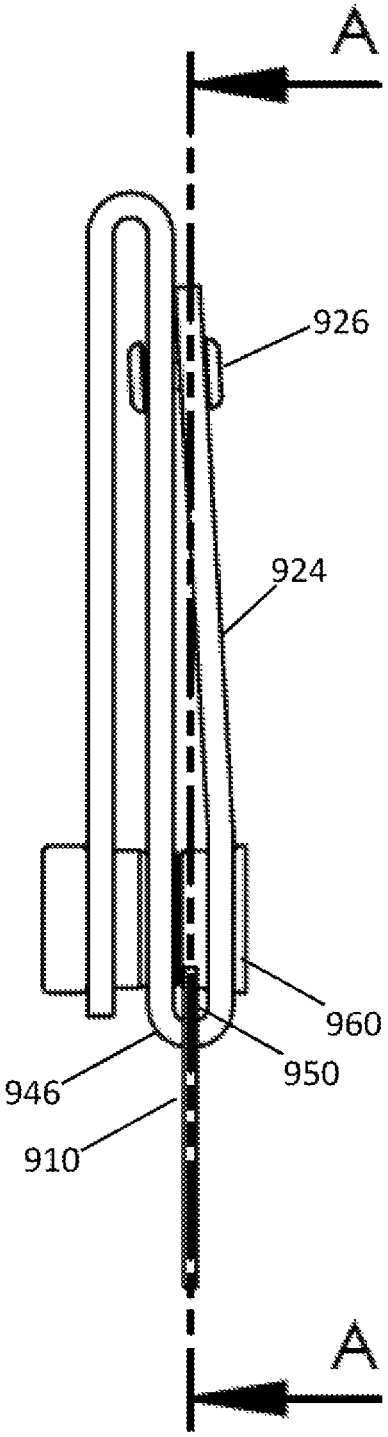
FIG. 9E is a side elevation view of the indented key ring installed in the slide cover of FIG. 9C in a closed configuration of the slide cover.
Figure 9F:
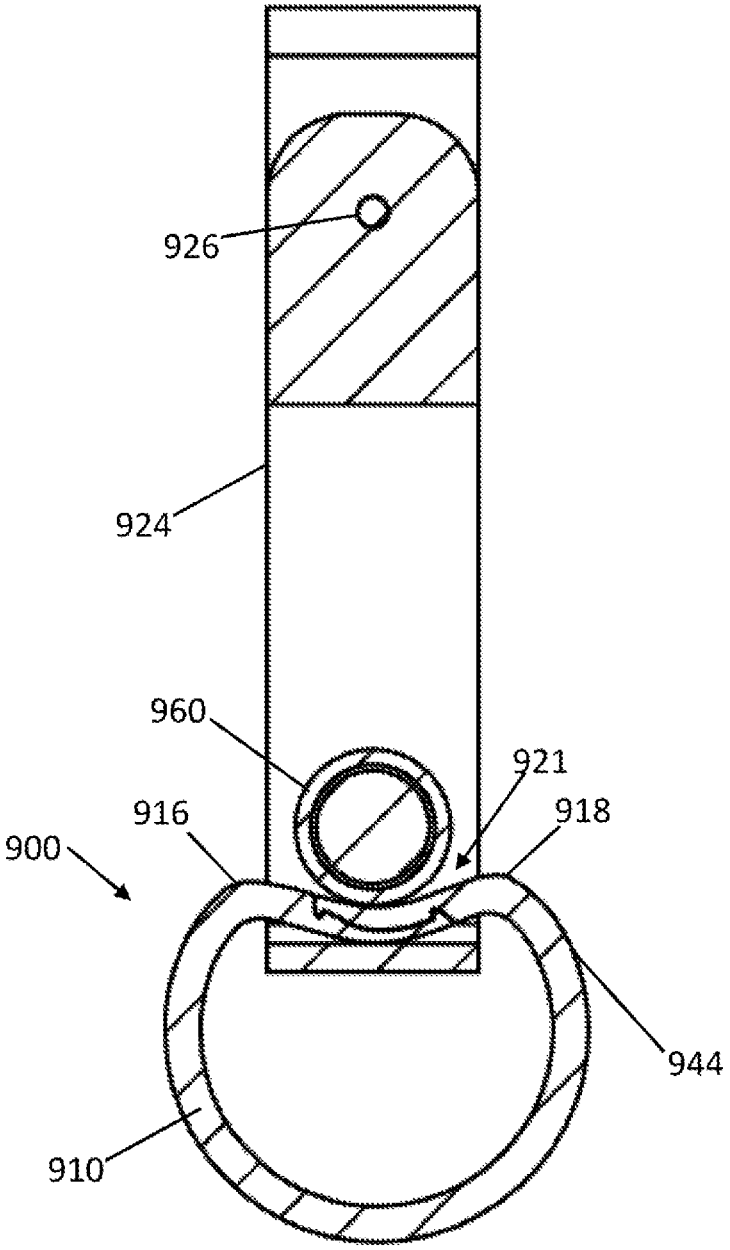
FIG. 9F is a bottom cross-sectional view of section A-A of the indented key ring installed in the closed slide cover of FIG. 9E.

As shown in FIGS. 9C and 9F, the concave indentation 921 of the connecting section 922 is circular and concentric to a mechanical clasp 960 of a slide cover 924. However, it will be apparent in view of this disclosure that the indentation 921 of the connecting section 922 may be a polyarc or angular, and is not limited to a position that is concentric to the mechanical clasp 960. In some embodiments, the indentation 921 of the connecting section 922 may not be a concavity but simply a linear section. In some embodiments, the indentation 921 may project toward the interior of the body 910, form a protrusion and extend outward, away from the interior of the body 910, or may comprise an irregular shape or contour. In general, as appropriate for the particular geometry and configuration of the body 910, the connecting section 922, and the indentation 921, the inflection points 916 and 918 can be defined as any point at which the line of the outer edge 944 deviates from the general shape of the body 910. In accordance with various embodiments, as appropriate, each inflection point 916, 918 can be at least one of an angular deviation of any suitable angle or a rounded/filleted deviation of any suitable fillet radius.

A split 920 is located within the connecting section 922 and separates the connecting section 922 into outer segment 930 and inner segment 940. Generally, the outer segment 930 and the inner segment 940 can be complimentarily contoured for securing the outer segment 930 to the inner segment 940 and permitting releasable detachment of the outer segment 930 from the inner segment 940.

The mechanical clasp 960, can be formed in a number of ways, including but not limited to, a button snap, a "dress" button combined with a mating slit in the slide cover 924, a "jean" button with stud and mating slit in the slide cover 924, a hook and eye, cord stopper, toggle clasp, screw and post, bolt and nut, and cufflink stud with slits in either side of the slide cover 924.

Referring now to FIGS. 9C-9F, the slide cover 924 may be optionally included with the key ring 900. The slide cover 924 is secured about the body 910 by means of a fastener 926 which can include, but is not limited to, a grommet, a rivet, a screw and post, a stitching, or a bonding. In the present embodiment the slide cover is a strap 924, but it will be apparent in view of this disclosure that, in some embodiments, the slide cover 924 can include, for example, but not limited to, components such as a key fob, a strap, a tag, a tool, a case, or other components integral to body 910. The material of the slide cover 924 can include, for example, natural or synthetic fabrics, nylon straps, carbon fiber textiles, leather, synthetic leather, rubber, plastic sheet, plastic strapping, cord, twine, rope, elastic cord, other suitable materials, or combinations thereof suitable for use in order to obtain the desired characteristics.

As shown in FIGS. 9C-9F, the slide cover 924 can, in some embodiments, be configured as a strap having a rolled end forming a loop 946, wherein a closable passage 950 is formed between the loop 946 and mechanical clasp 960, through which the body 910 is passed. Alternatively, in some embodiments where the slide cover 924 is a tag or handle, rather than a loop 946, the closable passage 950 may be created by positioning the fastener 926 in close proximity to an outer edge 944 of the body 910 of the key ring 900. As shown in FIGS. 9C-9F, the slide cover 924 may be configured to provide an open configuration, shown in FIG. 9D, wherein the mechanical clasp 960 is in an open position, thus providing sufficient slack within the closeable passage 950 to freely rotate the key ring 900 within the slide cover 924. The slide cover 924 can further be configured to provide a closed configuration, shown in FIG. 9E, wherein the mechanical clasp 960 is in a closed position, thus removing sufficient slack from the closeable passage 950 to prevent rotation of the key ring 900 within the slide cover 924.

To that end, as best shown in FIG. 9F, the mechanical clasp 960 can be positioned on the slide cover 924 such that, in the closed configuration, an outer radius of the mechanical clasp 960 is accommodated by an inner radius of the concave indentation 921 of the key ring 900. In particular, the inner radius of the indentation 921 can be sized to accommodate the outer radius of the mechanical clasp 960 when the slide cover 924 positioned to cover the split 920 and the connecting section 922 as shown, for example, in FIGS. 9C and 9F. Thus, in the closed configuration of the slide cover 924, the mechanical clasp 960 can be positioned so that movement or rotation of the slide cover 924 is restricted by the inflection points forming corners 916 and 918 of the body 910.

In use, in order to prevent inadvertent opening of the split 920, with the slide cover 924 in the open configuration, the key ring 900 can be rotated by the user to align the indent 921 with the mechanical clasp 960. The user can then close the clasp 960 to place the slide cover 924 in the closed configuration, thereby restricting further rotation by the key ring 900 within the closeable passage 950 of the slide cover 924.

In such embodiments, when the slide cover 924 is in the closed configuration and aligned with the indented portion, as best shown in FIGS. 9C and 9F, the split 920 is covered and secured by the slide cover 924, thereby restricting rotation and separation of the split 920 to prevent accidental separation of the outer segment 930 and inner segment 940. Preventing accidental separation of the split 920 can thus aid in avoidance of inadvertent loss of keys or other items that may be held on the body 910 of the key ring 900.

The opening orientation of the mechanical clasp 960 is preferably perpendicular to the plane of the key ring body 910 in order to prevent the key ring 900 from catching on foreign bodies and pulling the mechanical clasp 960 open. Accordingly, a force required to open the mechanical clasp 960 can be lower than forces (e.g., rotation or twist) applied to the key ring 900 in use while preserving the restriction of rotation and separation of the split 920.

In some embodiments, the mechanical clasp 960 may be a separate element that is not contiguous with the slide cover 924. In such embodiments, the closable passage element 950 can be integral to the mechanical clasp 960.

In another embodiment, the mechanical clasp 960 can be a cord stopper and the slide cover 924 can be a cord or rope. In such embodiments, the user can squeeze the cord stopper to open it and slide the rope through to enlarge the closable passage 950 so that the key ring body 910 can slide to open the split 920.

In another embodiment, the slide cover can have a secondary loop and a secondary mechanical clasp to allow the user to releasably secure the key chain to various objects, such as a belt, belt loop or bag, using the secondary loop. The mechanical clasp and the secondary mechanical clasp can also be arranged in collinear fashion where the components of the mechanical clasp and secondary mechanical clasp can be integrated to one another. The slide cover loop and secondary loop can all be made of the same contiguous material, or alternatively, made from more than one piece, and optionally more than one material.

Those skilled in the art will appreciate that the conception, upon which this disclosure is based, may readily be utilized as a basis for designing other products without departing from the spirit and scope of the invention as defined by the appended claims. Therefore, the claims are not to be limited to the specific examples depicted herein. For example, the features of one example disclosed above can be used with the features of another example. Furthermore, various modifications and rearrangements of the parts may be made without departing from the spirit and scope of the underlying inventive concept. For example, the geometric configurations disclosed herein may be altered depending upon the application, as may the material selection for the components. Thus, the details of these components as set forth in the above-described examples, should not limit the scope of the claims.

What is claimed is:

1. A low-profile key ring comprising:

a planar body including first and second inflection points;

a connecting section extending between the first and second inflection points to define a concave indentation of the planar body; and a split disposed in the connecting section to define an outer segment and an inner segment of the connecting section, wherein the outer segment and inner segment are complementarily contoured.

2. The low-profile key ring of claim 1, wherein the complimentary contouring of the outer segment and the inner segment is suited for securing the outer segment to the inner segment and releasably detaching the outer segment from the inner segment.

3. The low-profile key ring of claim 2, wherein the outer segment or the inner segment further comprises at least one protrusion and at least one slot.

4. The low-profile key ring of claim 1, further comprising a slide cover configured to slide over at least one of the first inflection point or the second inflection point to cover the connecting section.

5. The low-profile key ring of claim 4, wherein the slide cover further comprises:

a loop extending through the planar body; and a mechanical clasp positioned proximate the loop for defining a closeable passage.

6. The low-profile key ring of claim 5, wherein the closeable passage, in an open configuration of the mechanical clasp, is sized to permit rotation of the planar body therethrough.

7. The low-profile key ring of claim 5, wherein the closeable passage, in a closed configuration of the mechanical clasp, is sized to restrict rotation of the planar body therethrough.

8. The low-profile key ring of claim 5, wherein the concave indentation is sized to accommodate the mechanical clasp.

9. The low-profile key ring of claim 8, wherein, when the mechanical clasp is in a closed configuration and accommodated within the concave indentation:

the slide cover covers the connection section; and the outer segment and the inner segment are restricted from releasably detaching at the split.

10. The low-profile key ring of claim 5, wherein the slide cover further comprises:

a fastener for securing the loop around the planar body.

11. The low-profile key ring of claim 10, wherein the slide cover further comprises:

a secondary loop and secondary mechanical clasp for releasably securing the secondary loop to various objects, including personal carry.

12. The low-profile key ring of claim 11, wherein the mechanical clasp and the secondary mechanical clasp are arranged in a collinear fashion.

13. A method of making a low-profile key ring comprising the steps of:

cutting or stamping a planar body wherein the body is shaped as substantially circular, oval, elliptical, square, rectangular, trapezoidal, S-shaped, or polygonal, and includes:

first and second inflection points, and a connecting section extending between the first and second inflection points to define a concave indentation of the planar body;

creating a split in the connection section wherein the split forms an outer segment and an inner segment within the connection section, the outer and inner segments further comprising complimentary contouring; and securing a loop of a slide cover to the body, the slide cover configured to slide over at least one of the first inflection point or the second inflection point to cover the connecting section upon application of manual force.

14. The method of claim 13, further comprising installing a mechanical clasp in the slide cover, the mechanical clasp sized to be accommodated by the concave indentation of the body.

15. The method of claim 14, further comprising:

rotationally aligning the mechanical clasp with the concave indentation; and closing the mechanical clasp to restrict rotation of the body relative to the slide cover and to restrict the outer segment and the inner segment from releasably detaching at the split.

* * * * *